US005927593A

United States Patent [19]

Berkowitz et al.

[11] Patent Number: 5,927,593

[45] Date of Patent: Jul. 27, 1999

[54] COLLAPSIBLE CONTAINER

[75] Inventors: Gary Berkowitz, Lawrence; Christopher Broszeit, Babylon, both of N.Y.

[73] Assignee: Island Container Corporation, Wheatly Heights, N.Y.

[21] Appl. No.: 09/075,474

[22] Filed: May 8, 1998

[51] Int. Cl.[6] ..... B65D 5/36

[52] U.S. Cl. ..... 229/117; 229/117.03; 229/185.1; 229/145

[58] Field of Search ..... 229/117, 117.03, 229/145, 185.1

[56] References Cited

U.S. PATENT DOCUMENTS

| | | | |
|---|---|---|---|
| 100,865 | 3/1870 | Crosby . | |
| 668,239 | 2/1901 | Waldorf . | |
| 690,575 | 1/1902 | Herre . | |
| 770,915 | 9/1904 | Maunsell-Smyth . | |
| 1,167,409 | 1/1916 | Joslin . | |
| 1,468,696 | 9/1923 | Bray . | |
| 1,476,563 | 12/1923 | Wright . | |
| 1,597,065 | 8/1926 | Davis . | |
| 1,667,975 | 5/1928 | Labombarde . | |
| 1,857,270 | 5/1932 | Andrews . | |
| 1,957,264 | 5/1934 | Gross . | |
| 2,327,709 | 8/1943 | Himes . | |
| 2,348,378 | 5/1944 | Goodyear . | |
| 2,702,154 | 2/1955 | Linson | 229/117 |
| 3,844,473 | 10/1974 | Whelan . | |
| 3,927,824 | 12/1975 | Razziano . | |
| 4,007,869 | 2/1977 | Stolkin et al. . | |
| 4,126,266 | 11/1978 | Roccaforte | 229/117 |
| 4,182,477 | 1/1980 | Paige . | |
| 4,187,976 | 2/1980 | Mather . | |
| 4,289,268 | 9/1981 | Paige . | |
| 4,325,493 | 4/1982 | Paige . | |
| 4,373,660 | 2/1983 | Wytko | 229/145 |
| 4,406,380 | 9/1983 | Paige . | |
| 5,042,714 | 8/1991 | Hall | 229/117 |
| 5,664,726 | 9/1997 | Opper | 229/117 |

FOREIGN PATENT DOCUMENTS

| | | | |
|---|---|---|---|
| 1145309 | 4/1983 | Canada | 229/117.03 |

*Primary Examiner*—Gary E. Elkins
*Attorney, Agent, or Firm*—Helfgott & Karas, P.C.

[57] ABSTRACT

A foldable container folded into its final configuration from a single flat blank of material having side walls and end walls hingedly connected together along their side edges, two similarly sized larger bottom panels hingedly connected to the side walls and two similarly sized smaller bottom panels hingedly connected to end walls. Each larger bottom panel is hingedly attached to one adjacent smaller bottom panel, such that when the side walls are erected from their collapsed state, the bottom panels fold down from their respective side and end walls to provide a continuous floor on the bottom of the container, the larger bottom panels having relief flaps which deflect about hinges as they strike each other upon descending to their open position. The blank is optionally provided with additional panels which are hingedly attached and may be folded so as to form inner side and end walls to produce a double walled container increasing the container strength. An integrated cover is also provided.

15 Claims, 8 Drawing Sheets

COLLAPSIBLE CONTAINER

BACKGROUND OF THE INVENTION

This invention relates generally to foldable containers of the type usually formed of corrugated cardboard, and particularly to such containers which are usually in either an erect state or collapsed state. More specifically, the invention relates to foldable containers wherein various ends of bottom panels of the container are permanently hinged together in such a way that they automatically form the container floor when the side and end walls of the container are pulled apart to thereby erect the container.

U.S. Pat. No. 2,348,378 to Goodyear, shows a foldable container having hinged-together bottom panels for automatically forming the container floor when the container is erected. This container has a full sized bottom panel which covers the entire floor with one single smooth surface. Those skilled in the art will realize that such a container cannot open unless the container material is readily flexible so that the large bottom panel can deploy to the erect position. Thus, stiff strong materials can not be used to make containers according to this invention.

U.S. Pat. No. 4,007,869 to Stolkin et al., shows a foldable container having hinged-together bottom panels for automatically forming the container floor when the container is erected. This container does not have a full sized bottom panel as in Goodyear, but instead uses many panels which meet in the middle of the container floor with some minimal overlap. Thus, although this container may be made from stronger material than that of Goodyear, the floor is inherently weak because none of the bottom panels extend fully from one wall to an opposing wall.

U.S. Pat. No. 4,289,268 to Paige, shows a foldable container having hingedly connected bottom panels for automatically forming the container floor when the container is erected. Although this container does have a full sized bottom panel as in Goodyear, the large bottom panel has a long hinge line which virtually extends from one corner of the container to the other, thus weakening the floor. Also there is no mechanism to keep the container fully erect and thus the container has a tendency to collapse when empty.

Each of the above patents strives to provide a collapsible container with a floor which automatically deploys when the container is erected. In each of these patents, the bottom panels may interfere with each other and with the surrounding side and end walls as they deploy. This inherent difficulty is known in the art as bridging.

It is accordingly an object of the present invention to provide an improved automatic bottom container construction for corrugated container blanks.

It is another object of the present invention to provide a corrugated container with an automatic bottom feature which will not tend to collapse upon erecting.

It is a further object of the present invention to provide an automatic bottom container construction for corrugated container blanks which has floor panels extending fully from wall to opposite wall and further including provisions for avoiding bridging of the bottom panels during erecting and collapsing of the container.

It is a still further an object of the present invention to provide a foldable container with inner and outer walls being formed from a single corrugated blank to form a double walled container.

It is therefore an object of the present invention to provide a foldable container formed of relatively stiff corrugated cardboard, having permanently hinged-together bottom panels which automatically form the container floor when the container is unfolded into an erect condition, and wherein the bottom panels fold from a collapsed state to an erect state without impeding the deployment of each other.

SUMMARY OF THE INVENTION

The present invention relates generally to a foldable container which can be made from varying weights of corrugated cardboard with various ones of the bottom panels permanently attached to each other to effect an automatic deployment of the container floor as the side and end walls of the collapsed container are pulled apart. The container is in usually one of two states, either erect or collapsed. In the erect state, the container side and end walls are perpendicular to each other and to the bottom panels which comprise the floor. In a collapsed state, the bottom panels are folded up into the interior space between the walls and lie flat against their respective walls, allowing one side and end wall pair to flatten against the opposing side and end wall pair, rendering a flattened container.

The container is designed to be strong enough to carry heavy loads. Strength in cardboard containers is mainly a function of the inherent strength of the cardboard, primarily the thickness of the cardboard blank. The container includes generally rectangular side walls and end walls connected together to form a rectangular enclosure. A bottom floor assembly includes four bottom panels, two of which are larger and generally L-shaped extending from opposite walls and interlocking in the erect position to provide a complete container floor surface. Each L-shaped larger bottom panel has a short leg and a long leg. Each of the larger bottom panels is hingedly connected to a side wall along an edge of the long leg. In the erect state, the short leg extends from side to side, providing a strong continuous floor surface without interfering with the complimentary and opposing larger bottom panel's short leg. A relief flap constructed as part of each panel's short leg allows for deflection of the relief flap so that the short leg of each opposing larger bottom panel may pass by each other without undue mechanical interference during the erecting and collapsing transitions. The smaller bottom panels provide additional floor strength and support, and function with the larger bottom panels to facilitate the automatic floor erecting and collapsing.

Accordingly, in order to carry out the foregoing objects and intentions, the invention herein comprises the features that are fully described and particularly pointed out in the following detailed description, the referenced drawings and the claims appended hereto.

IN THE DRAWINGS

In the various figures of the drawings, like reference characters refer to like parts.

DETAILED DESCRIPTION

Figure 1:
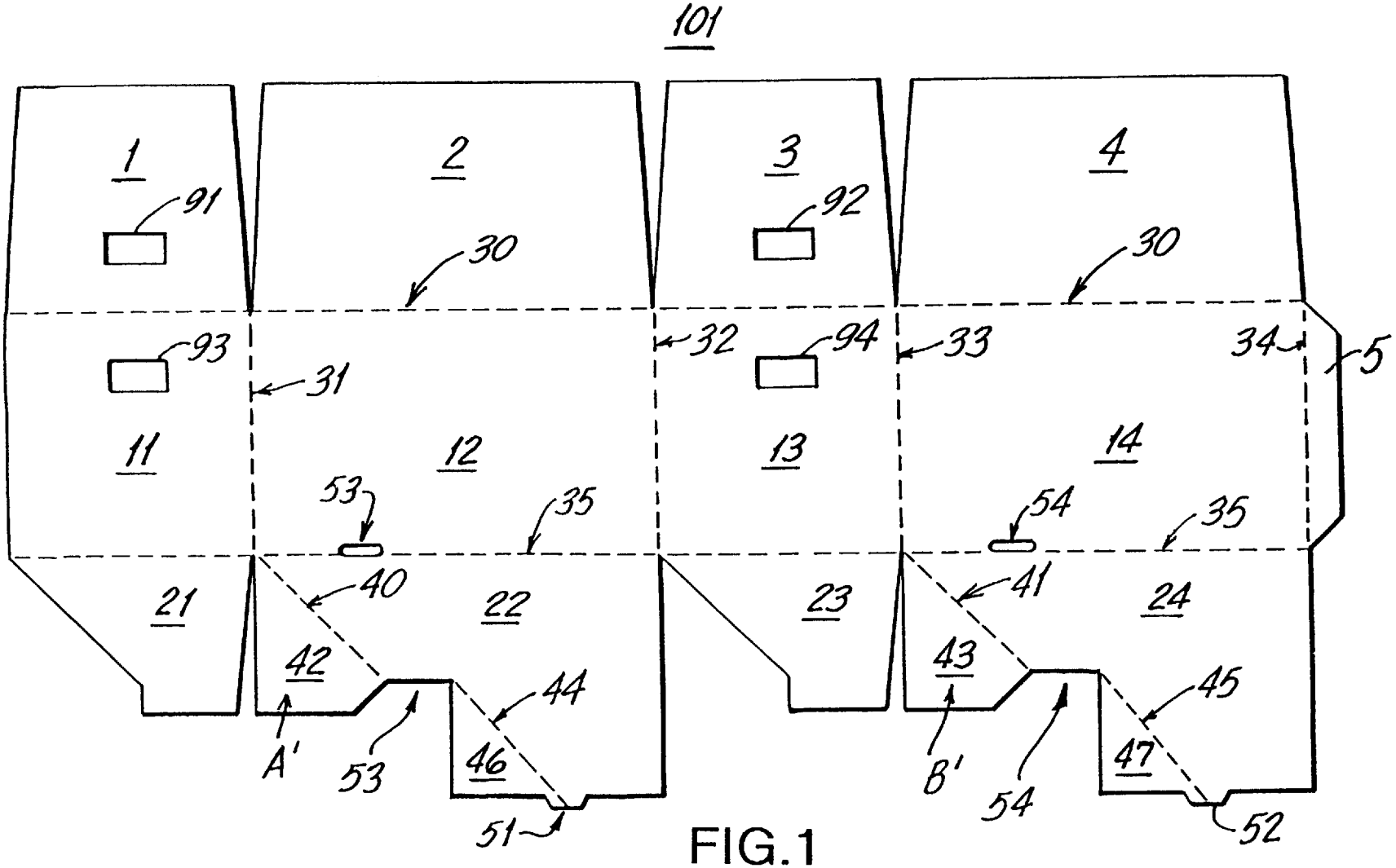
FIG. 1 is a pattern view of a blank of which a container may be formed according to a first embodiment of the invention.

Referring now to FIG. 1, a cardboard blank 101 of substantially rectangular shape is shown that is scored and cut to provide the different flaps and panels necessary for forming the container of the present invention. In the drawings, solid lines represent edges or through cuts, and dotted lines represent hinge lines. Usually the unprinted or inside container surface of the blank is face up on the work table. The blank 101 consists of a central portion defined by the outer container end walls 11 & 13 providing the container width, and the outer side walls 12 & 14 providing container length. Securing flap 5 is used to attach the unconnected edge of end wall 11 and side wall 14. The walls 11—14, and securing flap 5 are connected by four parallel hinge lines, 31—34. Locking apertures 53 & 54 are provided respectively in each side wall 12 & 14 near the hinge line 35.

Along the top edge of the outer walls 11–14 and hingedly connected along hinge line 30 are the inner walls 1–4. Each of the inner walls 1–4 is shaped and dimensioned similarly to its connected outer wall 11–14 except for some shaving on the side edges and top edge. This reduction in size of the inner walls 1–4 is to accommodate the lessened perimeter available on the interior surface of the formed container due to wall thickness.

Lifting knockouts 91–94 are cut out (as shown in FIG. 1) or scored for later optional removal (not shown) in their respective inner end walls 1 & 3 and outer end walls 11 & 13, so that when inner walls 1 & 3 are folded about hinge line 30 onto outer walls 11 & 13, the inner wall knockouts 91 & 92 align respectively with their corresponding outer wall knockouts 93 & 94, thus providing through handles for grasping and lifting the container.

Along the bottom edge of the outer walls 11–14 and hingedly connected along hinge line 35, are the bottom panels 21–24. The larger bottom panels 22 & 24 are substantially identical to each other and hingedly extend from their respective side walls 12 & 14. These larger bottom panels 22 & 24 are cut and scored to form an essentially L-shaped pattern with each of the long legs being hinged to its respective side wall along hinge line 35. Each larger bottom panel 22 & 24, contains a respective one of the cooperating hinge lines 40 & 41 which originates from the distal corner of the long leg adjacent to the hinge line 35. These cooperating hinge lines 40 & 41 define glue flaps 42 & 43, which can rotate freely about their respective large bottom panels 22 & 24. Relief notches 53 & 54 are defined on the respective distal edges of the long leg of the larger bottom panels between the respective glue flaps 42 & 43 and short legs. Along the hinged edge of the long leg, locking apertures 53 & 54 are formed. Locking tabs 51 & 52 extend from the longitudinal center of each of the distal edges of the short leg of the larger bottom panels. Relief flap hinge lines 44 & 45 respectively located on each of the short legs of the larger bottom panels 22 & 24 extend from the center edge of each locking tab 51 & 52 towards their respective cooperating hinge lines 40 & 41 and terminating at respective relief notches 53 & 54. The relief flap hinge lines 44 & 45 respectively define that portion of each of the short legs which are the relief flaps 46 & 47.

Hingedly extending along hinge line 35 from end walls 11 & 13 are smaller bottom panels 21 & 23, each panel being generally, trapezoidaly shaped and substantially identical to each other. The unique shapes of the bottom panels are useful, as will become clear in the description which follows.

To assemble the container of this invention, and with reference to FIG. 1, the container will result upon final assembly, as a double walled, rectangular collapsible container having an interlocking floor.

The blank 101 is cut from cardboard stock (not shown). Glue is next applied to the inner walls 1–4 and they are then folded about hinge line 30 so that each inner wall 14–4 lies upon its respective outer wall 11–14. As the glue dries, a permanent bond is formed between the inner walls 1–4 and their respective outer walls 11–14. It should be noted that in the following descriptions of embodiments, and for reasons of simplicity, wherever inner walls 1–4 have been glued or bonded onto their respective outer walls 11–14, each such wall assembly is referred to solely by the outer wall's reference character. For example, a reference to end wall 11 of an assembled double walled container, would be understood to be a reference to the assembly of inner wall 1 glued or bonded to outer end wall 11.

Next bottom panels 21–24 are folded about hinge line 35 so that they come to rest on top of their respective inner walls 1–4. Glue flaps 42 & 43 are then folded about their respective hinge lines 40 & 41. Glue is then applied to surfaces A', B', and securing flap 5. Panels 1, 11 & 21 are then folded simultaneously about hinge line 31 so that bottom panel 21 comes in contact with glue covered surface A' of glue flap 42. Panels 4, 14 & 24 are then folded simultaneously about hinge line 33 so that bottom panel 23 comes in contact with glue covered surface B' of glue flap 43. At the same time glue coated securing flap 5 contacts the exposed outside edge of panel 11. The glue is allowed to set and forms permanent bonds between the respective panels. This bonding between each of the larger bottom panel glue flaps 42 & 43 and their respective adjacent smaller bottom panels 21 & 23 creates bottom panel pairs. It is this specific mechanical linkage joining larger bottom panels 22 & 24 and their respective smaller bottom panels 21 & 23 in conjunction with side and end wall movement which causes the bottom panels 21–24 to rotate about hinge line 35 when the container transitions between an erect state and a collapsed state. For example, in a collapsed state, bottom panels 21 & 22 are folded up about hinge line 35 so that each of them is laying upon their respective walls 11 & 12, and the walls 11 & 12, and the panels 21 & 22 are all sandwiched together. As the container transitions from the collapsed state to an erect state, end wall 11 rotates away from side wall 12 about hinge line 31, simultaneously pulling bottom panels 21 & 22 with their respective walls 11 & 12. However the permanent bond between glue flap 42 and smaller bottom panel 21 keeps them in physical contact so that the tension across that bottom panel pair is evidenced by the bottom panels 21 & 22 relative motion about the cooperating hinge 40 to flatten them into the floor position. The movement and forces of and on that bottom panel pair are reversed when the container transitions from the erect state to the collapsed state. The same process takes place for the opposite bottom panel pair.

It should be appreciated that the sequence of glue steps and folding steps could be modified, so long as the structural result is achieved.

Figure 1A:
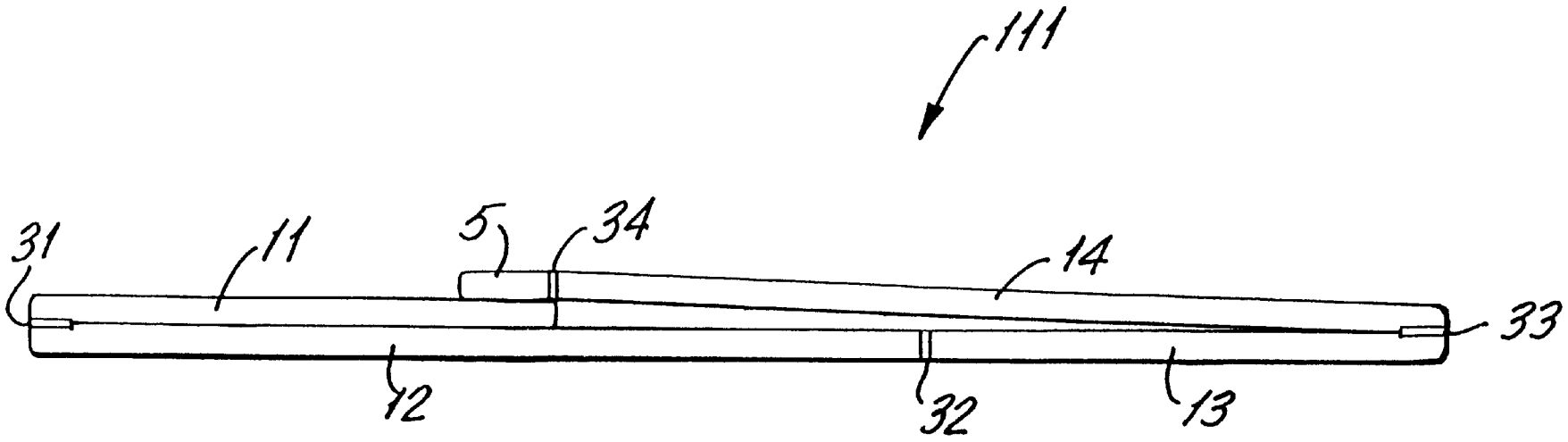
FIG. 1A is an elevation view of the container of FIG. 1 in the collapsed state.

Referring to FIG. 1A, the container 101 is now shown in its fully assembled but collapsed configuration, as 111. In this configuration, the container may be stored or shipped easily because it occupies the minimum volume possible. To open the container 111 for use, the user pulls apart the side and end walls 11–14 by applying pressure on the inside surfaces of hinges 32 & 34.

Figure 2:
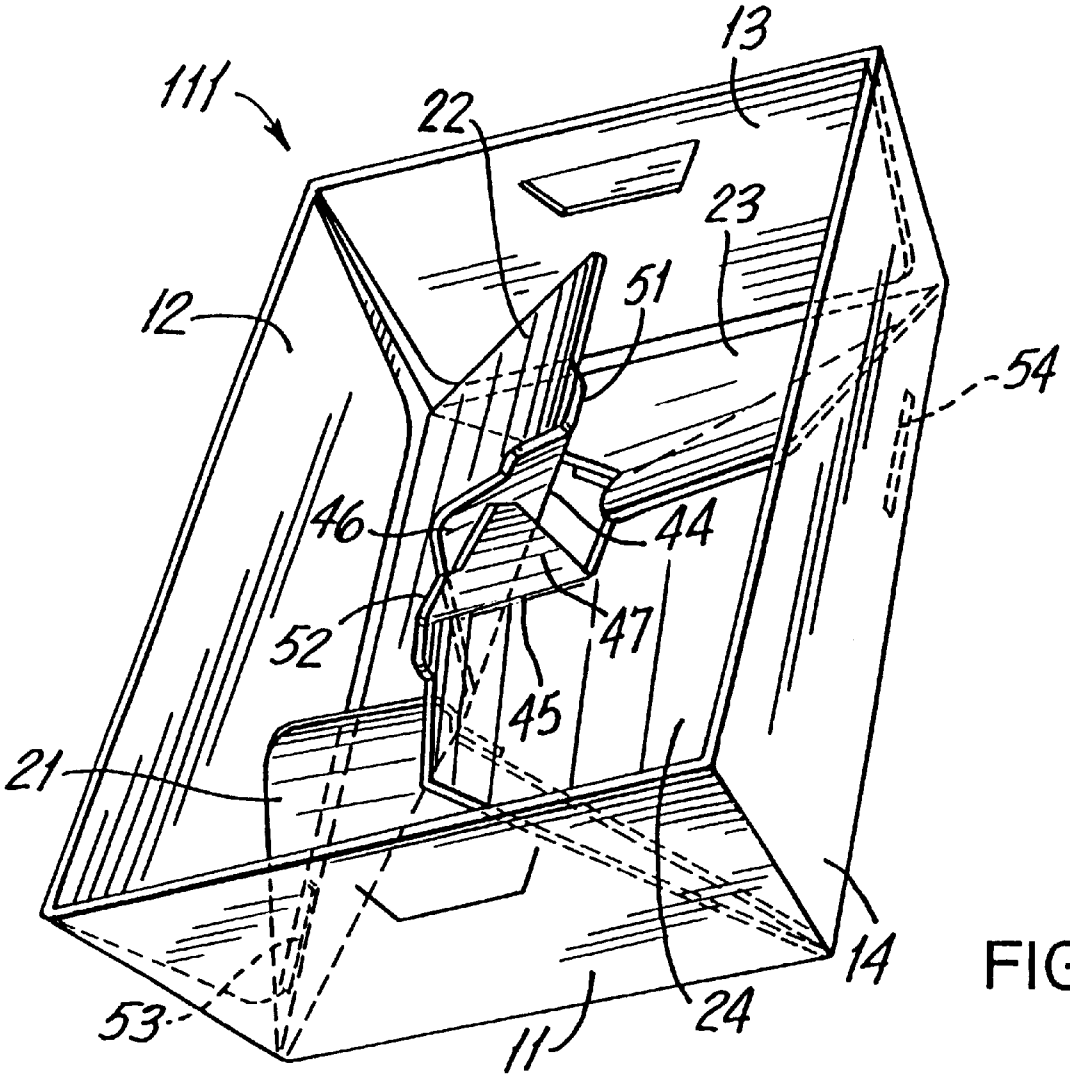
FIG. 2 is a perspective view of the first embodiment of the invention in transition between an erect state and a collapsed state.

Referring to FIG. 2, as the side walls 11–14 begin to separate from each other, the container 111 begins to erect, and the floor panels 21–24 begin to fold down automatically. The large bottom panels 22 & 24 begin to strike each other and then slide against each other respectively. However once the ends of the respective relief flap hinge lines 44 & 45 coincide upon and begin to pass each other, the relief flaps 46 & 47 begin to fold back from each other about their respective hinge lines 44 & 45. This allows the two larger bottom panels 22 & 24 to pass each other as they descend towards their final position as open and flat bottom panels. To lock each larger bottom panel 22 & 24 down, manual pressure is applied to their exposed surface forcing them down to a final flat bottom position wherein each of their respective locking tabs 51 & 52 lock into locking apertures 53 & 54. These locking tabs 51 & 52 maintain each of their respective bottom panels in a flat and locked position. This alleviates one of the major complaints with respect to collapsible containers in that most floors are non locking and the containers do not stay fully erect, but have a tendency to begin collapsing immediately.

Figure 1B:
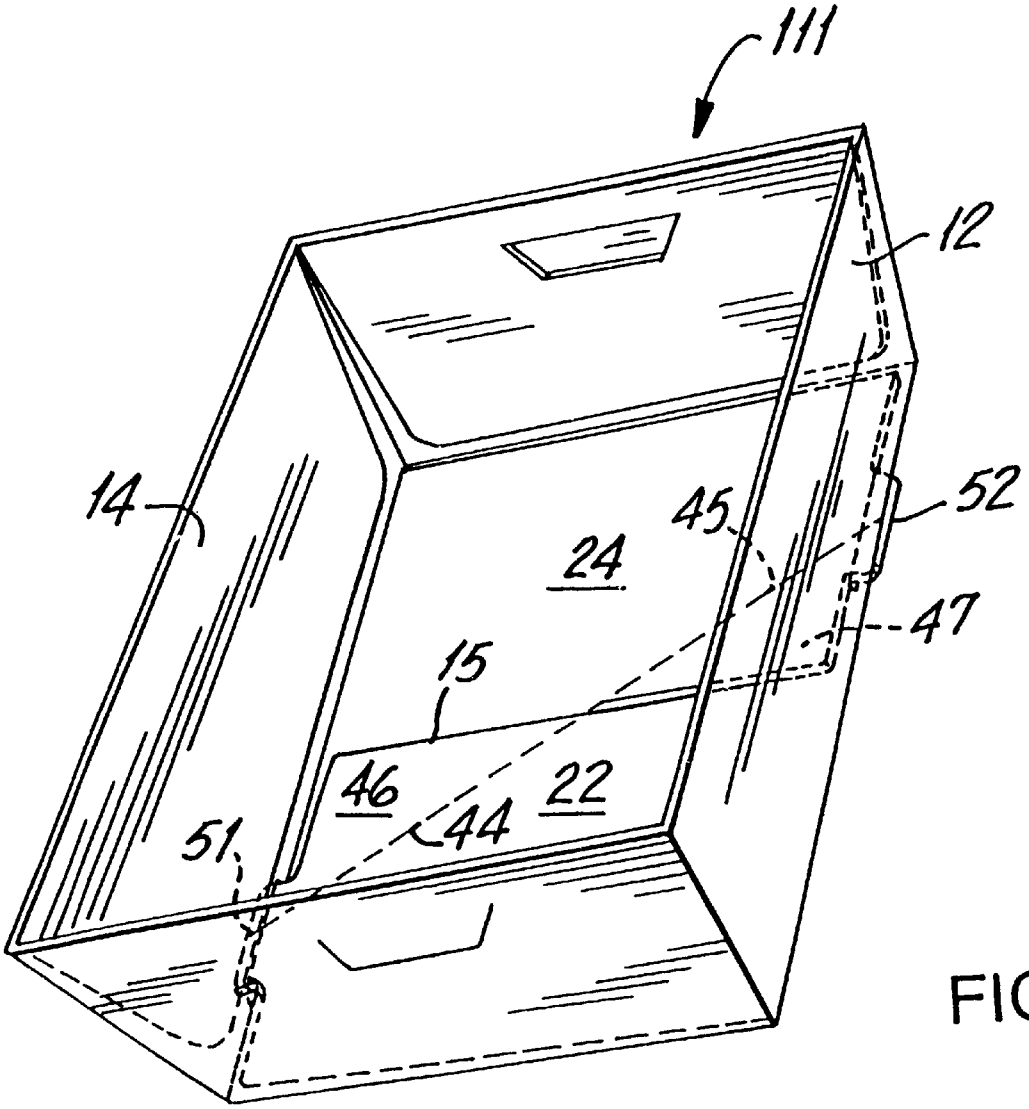
FIG. 1B is a perspective view of the first embodiment of the invention in an erect state.

As shown in FIG. 1B, with the container erected, the two short legs of the larger bottom panels 22 & 24 respectively extend from side wall to side walls 12 & 14. Each of these legs substantially covers one half of the floor surface. The two exposed halves meet along a meeting line 15 at about the center of the container floor. The floor that is formed is thus substantially rigid and secured.

It will be noted that once erected, the two hinge lines 44 & 45 line up in a substantially collinear manner. Also, it is noted from FIG. 1 that the hinge lines 40 & 41 are respectively parallel to hinge lines 44 & 45. In the embodiment shown the angle of the hinge lines 40, 41, 44, & 45 with respect to hinge line 35 is about 45 degrees.

To collapse the container 111, the relief flaps 46 & 47 which may be used as handles, are lifted and pulled up, which pops each of their respective locking tabs 51 & 52 from their respective locking apertures 53 & 54. Once each of the tabs 51 & 52 pop free, the bottom panels 21–24 begin to ascend. The container 111 begins to collapse with all of the walls 11–14 and bottom panels 21–24 reversing their respective relative motions performed during the erecting sequence. Again the relief flaps 46 & 47 fold away from each other about their respective hinge lines 44 & 45. This allows the large bottom panels 22 & 24 to pass each other as they ascend towards their final position in the collapsed state wherein each of the bottom panels 21–24 rest in contact against their respective wall panels 11–14.

Figure 3:
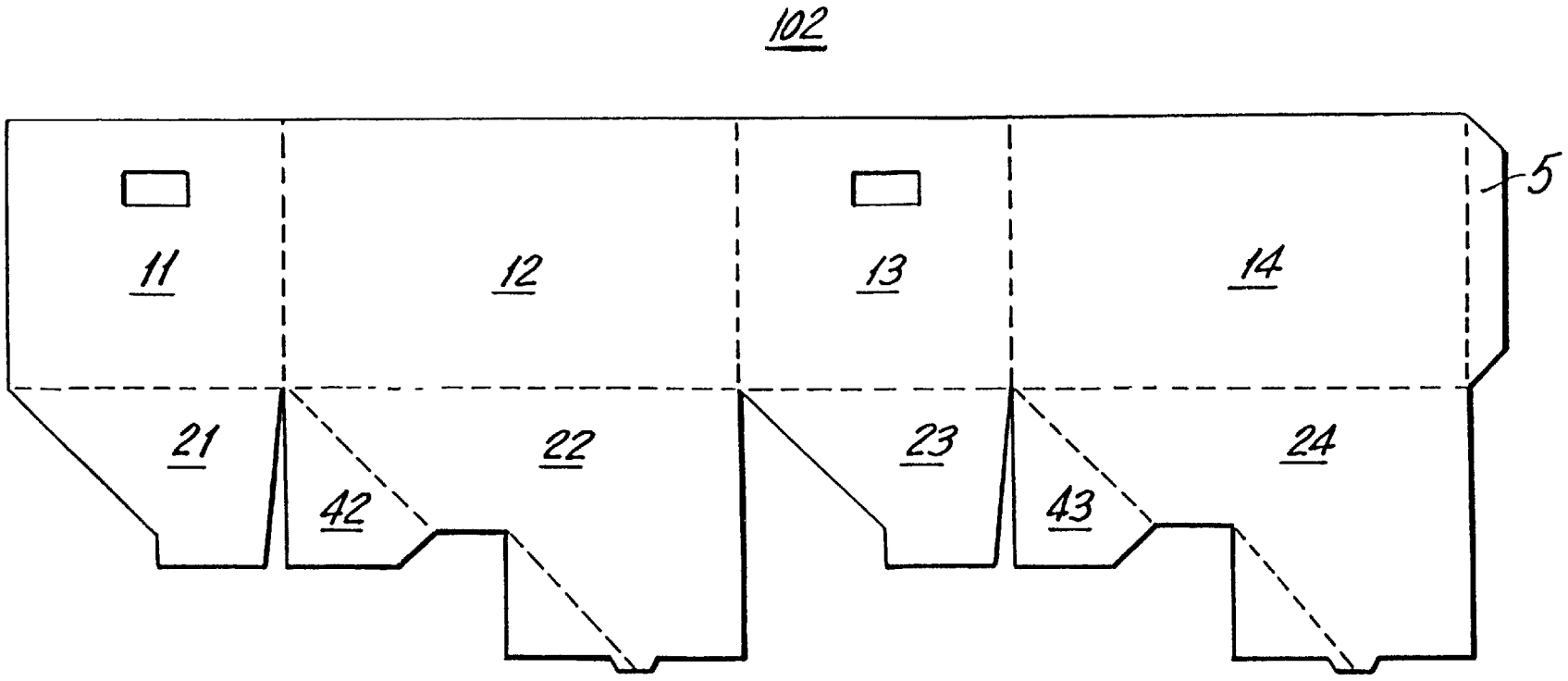
FIG. 3 is a pattern view of a blank of which a container may be formed according to a second embodiment of the invention.

Referring to FIG. 3, a second embodiment of a cardboard blank is shown at 102. In this configuration the blank 102 is substantially identical to blank 101 of the first embodiment except panels 1–4 have been eliminated so that the final container will only have single thickness walls 11–14. This produces a lighter container for applications which do not require the strength and expense of a double walled container. Gluing of panels 5, 42 & 43 and assembly of the container is performed in the same manner as described above in the first embodiment. Also the method of erecting and collapsing the container is substantially identical as that in the first embodiment because bottom panels 21–24 are substantially identical to those in the first embodiment.

Figure 4:
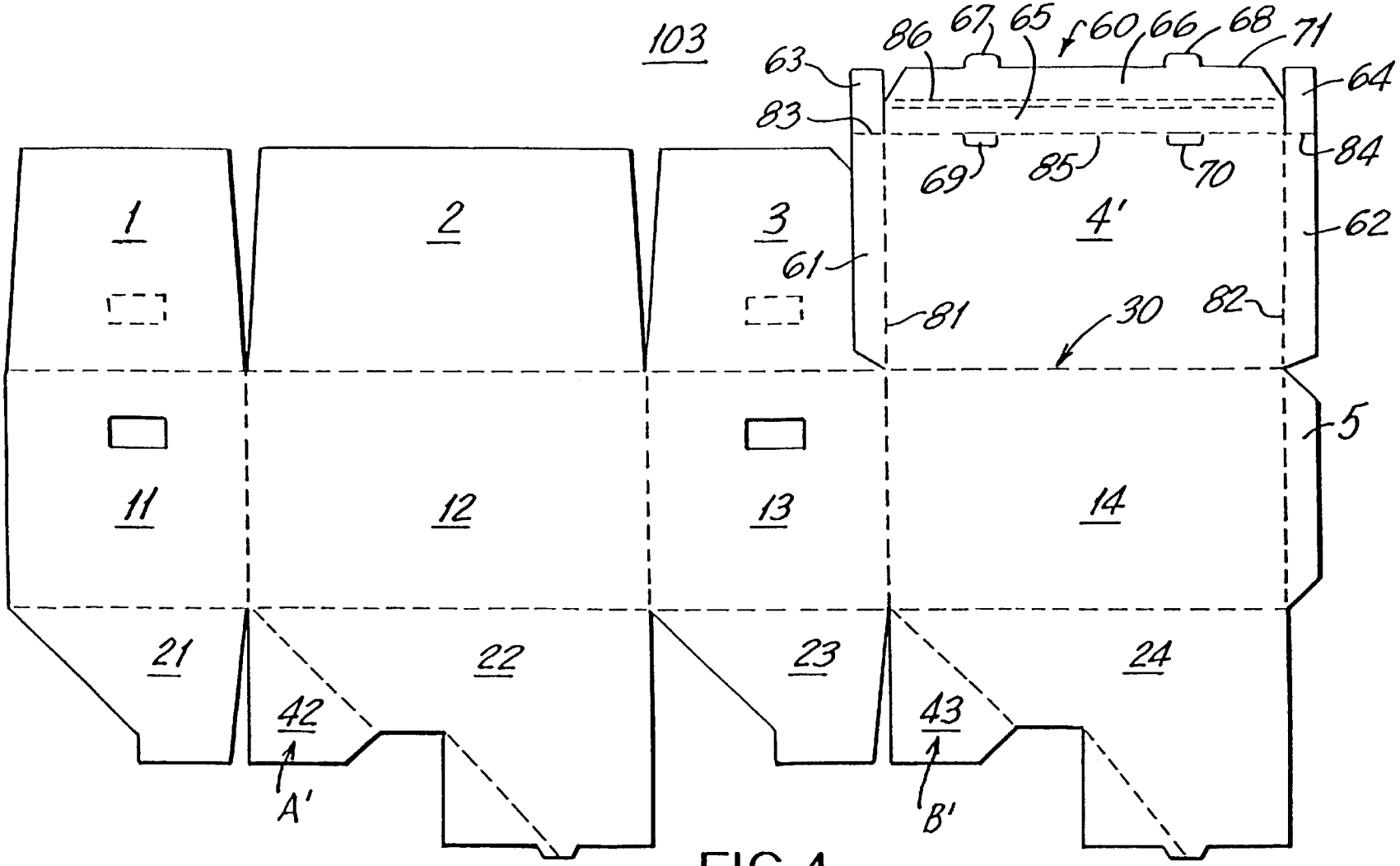
FIG. 4 is a pattern view of a blank of which a container may be formed according to a third embodiment of the invention.

Referring to FIG. 4, a modification to the first embodiment is shown resulting in a third embodiment. In this embodiment an integrated cover 60 is designed into the blank resulting in blank 103. Note that part of inner wall 3 and all of inner wall 4 as shown in FIG. 1 have become panel 4' in FIG. 4. The cover 60 contains the main panel 4' with side flaps 61 & 62, and a front flap 71. Again gluing and assembly of the inner walls 1–3 to their respective outer walls 11–13, bottom panels 21, 23 to their adjacent bottom panels 22, 24, and securing flap 5 to outside edge of wall 11, is performed in the same manner as described above, resulting in a container in a collapsed configuration. The cover 60 remains in an unfolded state until the container is to be used. To assemble the cover 60 for use, the side flaps 61 & 62 are folded 90° about hinge lines 81 & 82 respectively. Tongues 63 & 64 are folded about their respective hinge lines 83 & 84 so as to align them in a coplanar manner and coincident with hinge line 85. Front flap assembly 71 then folds 90° along hinge 85 as flap 65 becomes essentially co-planar with tongues 63 & 64. Front flap 66 then folds 180° about double hinge line 86 until locking tabs 67 & 68 interlock into their respective locking apertures 69 & 70, while tongues 63 & 64 are captured between flaps 65 & 66. The top cover 60 is now fully assembled and operational as it opens and closes by moving about hinge line 30.

Figure 5:
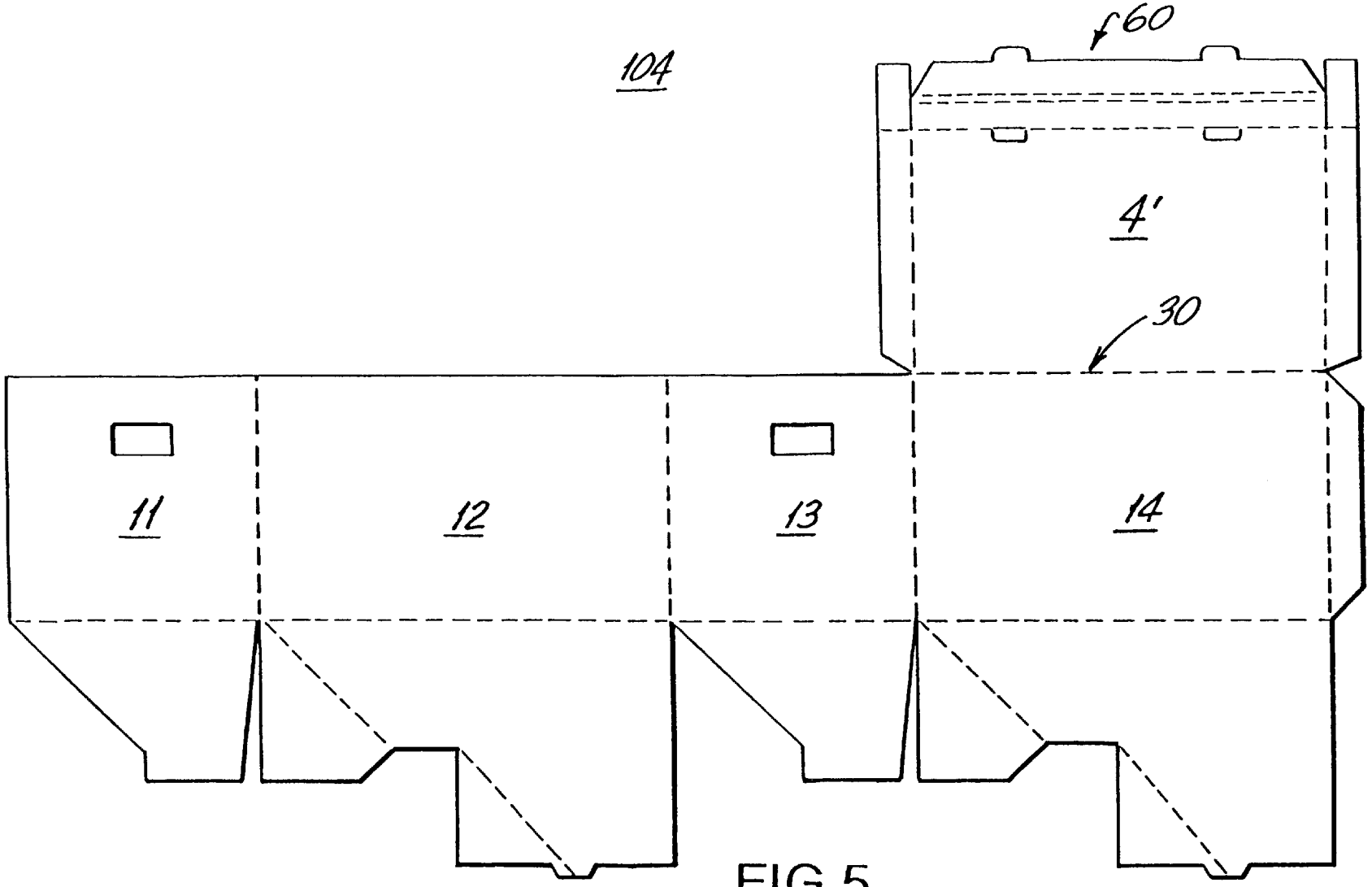
FIG. 5 is a pattern view of a blank of which a container may be formed according to a fourth embodiment of the invention.

Referring to FIG. 5, a modification to the second embodiment is shown resulting in a fourth embodiment. In this embodiment the integrated cover 60 is designed into a blank resulting in blank 104. The cover 60 has the same components and is assembled and operated in the same manner as in third embodiment. However in this embodiment there are no double outer walls.

It should be noted in the two foregoing embodiments that the cover 60 can be located above any of the walls 11–14 depending on the desired location. Of course it is well known by those skilled in the art that the cover 60 will have to be dimensioned appropriately for each different position it takes on the container, and that the design of the inner walls 1–4, if included, will be appropriately adjusted for the location of the cover 60.

Figure 6:
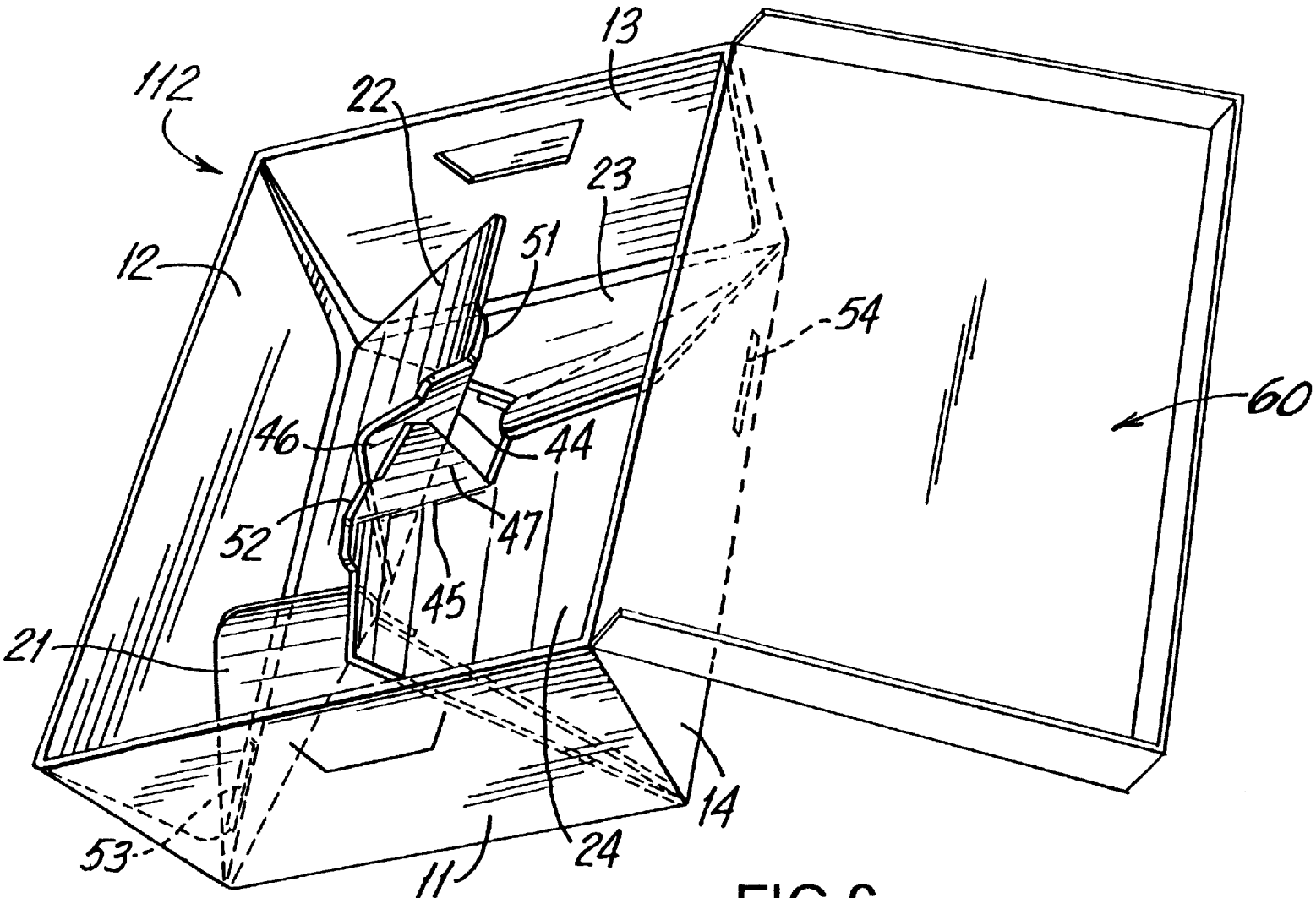
FIG. 6 is a perspective view of the third embodiment of the invention in transition between an erect state and a collapsed state.

Referring to FIG. 6, a perspective view of the third embodiment 112 is shown in a condition between the erect and collapsed states.

It should be appreciated that modifications can be made to the specific details shown, and still fall within the scope of the invention. For example, some shapes of the bottom panels could be modified. The smaller bottom panels could be shaped so that they closer match the shape of the glue flaps 42 & 43. The location and angle of the hinge lines 40, 41, 44 & 45 could be modified to alter the shape and size of the glue flaps 42 & 43 and the relief flaps 46 & 47. Further, some changes could be made whereby the two larger 22 & 24 and two smaller bottom panels 21 & 23 need not be substantially identical. Therefore, the spirit and scope of the appended claims should not be limited to the description of the preferred embodiments contained herein.

We claim:

1. A foldable storage container which folds between an erect state and a collapsed state comprising side walls, end walls and a floor;

each said side wall being hingedly connected to said end walls to form a substantially rectangular outer enclosure;

said floor comprising two larger bottom panels and two smaller bottom panels, each larger bottom panel hingedly connected to a respective side wall and each smaller bottom panel hingedly connected to a respective end wall;

each one of said larger bottom panels being secured to a corresponding one of said smaller bottom panels to define a bottom panel pair, a cooperating hinge line associated between said secured bottom panels of each bottom panel pair, whereby respectively each bottom panel pair can in the collapsed state fold upwardly between the side and end walls to which its bottom panels are connected and in the erect state fold downward to form a part of the floor; and a pair of relief flaps hingedly formed respectively on each of the larger bottom panels opposingly along a meeting line between the two larger bottom panels in the erect state, said relief flaps folding to permit passage of the two larger bottom panels against each other in movement between the erect and the collapsed states.

2. A foldable storage container as in claim 1, and further comprising a relief flap hinge line between each relief flap and its respective larger bottom panel, and wherein said relief flap hinge lines on said two larger bottom panels are collinear when the container is in the erect state.

3. A foldable storage container as in claim 2, wherein said cooperating hinge lines are parallel to said relief flap hinge lines.

4. A foldable storage container as in claim 3, and further comprising a relief notch in each of said larger bottom panels spaced between the cooperating hinge line and the relief flap hinge line of that larger bottom panel.

5. A foldable storage container as in claim 1, and further comprising locking means for fixing said larger bottom panels in their floor position in the erect state.

6. A foldable storage container as in claim 1, wherein said locking means comprise apertures along a hinge line between at least one bottom panel and its respective wall, and a locking tab extending from another bottom panel for engaging said aperture.

7. A foldable storage container as in claim 1, wherein both said larger bottom panels are substantially identical to each other.

8. A foldable storage container as in claim 1, wherein both said smaller bottom panels are substantially identical to each other.

9. A foldable storage container as in claim 1, wherein each of said larger bottom panels comprise a glue flap adjacent the smaller bottom panel of its bottom panel pair, and wherein said cooperating hinge line is in said larger bottom panel to define said glue flap.

10. A foldable storage container as in claim 9, wherein said glue flap of a larger bottom panel is secured to an underside of the smaller bottom panel in that bottom panel pair, and wherein the smaller bottom panel in that bottom panel pair comprises an extending portion overlying a part of the larger bottom panel to which it is secured.

11. A foldable storage container as in claim 1, wherein each of the larger bottom panels is of substantially L-shaped configuration, with the shorter leg of the L-shape forming one half of the floor surface of the container.

12. A foldable storage container as in claim 1, wherein said relief flaps form a pair of handles for pulling up said larger bottom panels to move the container from its erect state to its collapsed state.

13. A foldable storage container as in claim 1, wherein said container is initially formed from a flat blank, and further comprising a securing tab extending from one of said walls, a hinge line formed between said securing tab and the wall from which it extends, and means for securing said securing tab to another wall to form the outer enclosure.

14. A foldable storage container as in claim 1, and further comprising an additional one of each said side and end walls hingedly connected to and overlying the side and end walls forming said outer enclosure in the erected state to form a double walled container.

15. A foldable storage container as in claim 1, and further comprising a cover hingedly extending from a top edge of one of said walls, said cover comprising a top flap and a side perimeter skirt depending therefrom, said cover operational to open and close the container.

* * * * *